US007777551B2

(12) United States Patent
Kimura

(10) Patent No.: US 7,777,551 B2
(45) Date of Patent: Aug. 17, 2010

(54) MULTIPLIER CIRCUIT

(75) Inventor: Katsuji Kimura, Kanagawa (JP)

(73) Assignee: NEC Electronics Corporation, Kanagawa (JP)

( * ) Notice: Subject to any disclaimer, the term of this patent is extended or adjusted under 35 U.S.C. 154(b) by 65 days.

(21) Appl. No.: 12/289,125

(22) Filed: Oct. 21, 2008

(65) Prior Publication Data

US 2009/0121772 A1 May 14, 2009

(30) Foreign Application Priority Data

Oct. 24, 2007 (JP) ..... 2007-276611

(51) Int. Cl.
*G06G 7/16* (2006.01)

(52) U.S. Cl. ..... 327/346; 327/349; 327/356; 327/359

(58) Field of Classification Search ..... 327/346–361; 455/323, 326
See application file for complete search history.

(56) References Cited

U.S. PATENT DOCUMENTS 5,438,296 A * 8/1995 Kimura ..... 327/560
5,444,648 A * 8/1995 Kimura ..... 708/835
5,712,810 A 1/1998 Kimura
5,986,494 A * 11/1999 Kimura ..... 327/359
6,563,365 B2 * 5/2003 Knierim et al. ..... 327/355
6,850,109 B2 * 2/2005 Kimura ..... 327/361

FOREIGN PATENT DOCUMENTS

JP 2671872 7/1997

OTHER PUBLICATIONS

K. Kimura, "An MOS Four-Quadrant Analog Multiplier Based on the Multitail Technique Using a Quadritail Cell as a Multiplier Core," IEEE Transactions on Circuits and Systems, vol. 42:8, Aug. 1995, pp. 1-7.

* cited by examiner

*Primary Examiner*—Dinh T. Le
(74) *Attorney, Agent, or Firm*—Foley & Lardner LLP

(57) ABSTRACT

Disclosed is a multiplier circuit including first and second squaring circuits comprising first and second differential MOS transistors respectively connected in cascode to first and second diode-connected MOS transistors. The first squaring circuit receives a differential sum voltage of a first input voltage and a second input voltage. The second squaring circuit receives a differential subtraction voltage of the first input voltage and the second input voltage. Outputs of the first and second squaring circuits are first and second terminal voltages of the first and second diode-connected MOS transistors. A differential voltage between the first and second terminal voltages corresponds to the product of the first and second input voltages.

5 Claims, 13 Drawing Sheets

MULTIPLIER CIRCUIT

REFERENCE TO RELATED APPLICATION

This application is based on and claims the benefit of the priority of Japanese patent application No. 2007-276611 filed on Oct. 24, 2007, the disclosure of which is incorporated herein in its entirety by reference thereto.

FIELD OF THE INVENTION

This invention relates to an analog multiplier circuit. More particularly, it relates to a multiplier circuit that may be formed to advantage on a semiconductor integrated circuit.

BACKGROUND

The technique for this sort of the multiplier circuit has so far been proposed by the present inventor. As the mathematical basis for obtaining a product of two signals, a quarter-square technique is known. The generalized equation has been presented by the present inventor as the following equations (1) and (2):

$$(ax+by)^2+\{(a-c)x+(b-1/c)y\}^2-\{(a-c)x+by\}^2-\{ax+(b-1/c)y\}^2=2xy \quad (1)$$

$$(ax+by+z)^2+\{(a-c)x+(b-1/c)y+z\}^2-\{(a-c)x+by+z\}^2-\{ax+(b-1/c)y+z\}^2=2xy \quad (2)$$

where a, b and c are constants and x, y and z are variables.

It suffices here to set the constants a, b and c, with x being a first input signal, y being a second input signal and z being an arbitrary variable.

For example, in a multiplier circuit, proposed by the presents inventor, a=b=c=1 is used, such that $$(x+y)^2-y^2-x^2=2xy \quad (3)$$

or $$(x+y+z)^2+z^2-(y+z)^2-(x+z)^2=2xy \quad (4)$$

In a multiplier circuit, proposed by Bult et al., a=b=1/2 and c=1 are used, such that $$(x/2+y/2)^2+(-x/2-y/2)^2-(-x/2+y/2)^2-(x/2-y/2)^2=2xy \quad (5)$$

or $$(x/2+y/2+z)^2+(-x/2-y/2+z)^2-(-x/2+y/2+z)^2-(x/2-y/2+z)^2=2xy \quad (6)$$

In another multiplier circuit, proposed by Bult, a=1/2 and b=c=1 are used, such that $$(x/2+y)^2+(-x/2)^2-(-x/2+y)^2-(x/2)^2=2xy \quad (7)$$

or $$(x/2+y+z)^2+(-x/2+z)^2-(-x/2+y+z)^2-(x/2+z)^2=2xy \quad (8)$$

While the equation (3) is noticed from time to time, the following equation (9):

$$(x+y)^2-(x-y)^2=4xy \quad (9)$$

obtained on re-arranging the equation (5) for simplification is generally called the quarter-square technique.

As indicated in the foregoing, a multiplier circuit is implemented by combining a summation circuit (subtraction circuit) and a multiplier core circuit having the function of a squaring circuit.

FIG. 1 is a diagram showing a configuration of a multiplier core circuit formed by a quadritail cell. The multiplier core circuit includes MOS transistors M1, M2, M3 and M4, having sources coupled together and connected to a current source. The drains of the transistors M1 and M2 are coupled together, while the drains of the transistors M3 and M4 are also coupled together.

Assuming that the voltage $V_1$, applied to the gate of the MOS transistor M1, is expressed as $V_{CM}+aV_x+bV_y$, the voltage $V_2$ applied to the gate of the MOS transistor M2, is expressed as $V_{CM}+(a-c)V_x+(b-1/c)V_y$, the voltage $V_3$, applied to the gate of the MOS transistor M3, is expressed as $V_{CM}+(a-c)V_x+bV_y$ and the voltage $V_4$, applied to the gate of the MOS transistor M4, is expressed as $V_{CM}+aV_x+(b-1/c)V_y$, drain currents $I_{D1}$, $I_{D2}$, $I_{D3}$ and $I_{D4}$ of the MOS transistors M1, M2, M3 and M4 may respectively be expressed by the following equations (10) to (13):

$$I_{D1}=\beta(V_{CM}+aV_x+bV_y-V_{SQ}-V_{TH})^2 \quad (10)$$

$$I_{D2}=\beta\{V_{CM}+(a-c)V_x+(b-1/c)V_y-V_{SQ}-V_{TH}\}^2 \quad (11)$$

$$I_{D3}=\beta\{V_{CM}+(a-c)V_x+bV_y-V_{SQ}-V_{TH}\}^2 \quad (12)$$

$$I_{D4}=\beta\{V_{CM}+aV_x+(b-1/c)V_y-V_{SQ}-V_{TH}\}^2 \quad (13)$$

In the above equations, β is a transconductance parameter of a unit transistor and is expressed as $$\beta=(1/2)\mu(W/L)(\in x/tox) \quad (14)$$

where μ denotes an effective electron mobility, ∈x denotes a dielectric constant of a gate insulating film, tox denotes a film thickness of a gate insulating film, W denotes channel width and L denotes a channel length.

If we put $z=V_{CM}-V_{SQ}-V_{TH}$, a differential output current ΔI of the multiplier core circuit may be found as $$\Delta I=(I_{D1}+I_{D2})-(I_{D3}+I_{D4})=2\beta V_x\times V_y \quad (15)$$

from which it is seen that the quadritail cell represents a multiplier core circuit.

It is noted that, from the following condition of the tail current:

$$I_{D1}+I_{D2}+I_{D3}+I_{D4}=I_0 \quad (16)$$

and from the input voltage at which transistors of the quadritail cell are pinched-off, the differential output current ΔI may be found in accordance with the following equation (17):

$$\Delta I = (I_{D1} + I_{D2}) - (I_{D3} + I_{D4}) \quad (17)$$

$$= \begin{cases} 2\beta V_x V_y \left(V_x^2 + V_y^2 + |V_x V_y| \le \frac{I_0}{2\beta}\right) \\ \frac{4}{3}\beta V_x V_y - \frac{1}{9}\mathrm{sgn}(V_x V_y)\{3I_0 + 2\beta(|V_x| + |V_y|)^2 - \\ 4\beta(|V_x| + |V_y|)\}\sqrt{\frac{3I_0}{\beta} - 2(|V_x| + |V_y|)^2 + 6|V_x V_y|} \\ \left(V_x^2 + V_y^2 + \left|V_x V_y\right| \ge \frac{I_0}{2\beta} \ge V_x^2 + \frac{V_y^2}{2} - |V_x V_y|\right) \\ \left(\beta V_y\sqrt{\frac{2I_0}{\beta} - V_y^2}\right)\left(V_x^2 + \frac{V_y^2}{2} - |V_x V_y| \ge \frac{I_0}{2\beta}\right) \end{cases}$$

It should be noted that here the errors in the Publications of the related art, inclusive of Publication 1, have been corrected in the above statements.

Thus, as for an input voltage at which a MOS transistor operating in the saturation region is not pinched-off, the product $V_x \times V_y$, where $V_x$, $V_y$ denote two input voltages, is obtained, as indicated by the equation (17), with the quadritail cell operating as a multiplier core circuit.

As the input voltage becomes higher, transistors that make up the quadritail cell get pinched off, and the multiplication characteristic of the circuit becomes deviated from the ideal characteristic.

FIG. 2 shows differential output current characteristics of the quadritail cell as calculated with the equation (17) with $V_y$ as a parameter. In FIG. 2, the input voltage range for the regular operation, shown by the equation (17), is indicated by a broken line.

Since the quadritail cell has only one tail current, the multiplier circuit suffers from limiting with increase in the input signal.

The operating range of the quadritail cell is shown in FIG. 3, in which errors of the related art Publication have been corrected. The operating range has two heart shapes inverted relative to and partially overlapped with each other, with the input voltage range for the regular operation ($V_x$,$V_y$) being of a rounded lozenge corresponding to the overlapped region which is shown shaded in FIG. 3.

A voltage summation circuit is now described. FIG. 4 shows a configuration of a voltage summation circuit implemented using two MOS differential pairs (M1, M2) and (M5, M6). The sources of the n-channel MOS differential pair (M1, M2) are coupled together and connected to a constant current source, and $V_{IN}$ is differentially applied to their gates. The sources of the n-channel MOS differential pair (M5, M6) are coupled together and connected to another current source. The drains of the n-channel MOS differential pair (M3, M4) are respectively connected to the drains of the MOS transistors M1 and M6. The drain of the MOS transistor M2 is connected to a power supply $V_{DD}$, whilst the drain and the gate of the MOS transistor M5 are respectively connected to the power supply $V_{DD}$ and to $V_{REF}$. The drain and the gate of the MOS transistor M6 are coupled together. The drain voltage (=gate voltage) of the MOS transistor M6 is to be $V_{OUT}$. The drain current $I_{D1}$ of the MOS transistor M1 is equal to the drain current $I_{D6}$ of the MOS transistor M6 ($I_{D1}=I_{D6}$), and the gate-to-source voltage $V_{GS1}$ of the transistor M1 is equal to the gate-to-source voltage $V_{GS6}$ of the transistor M6 ($V_{GS1}=V_{GS6}$). Since $I_{D1}+I_{D2}=I_{D5}+I_{D6}=I_{OO}$, $I_{D2}=I_{D5}$. The gate-to-source voltage $V_{GS2}$ of the transistor M2 is equal to the gate-to-source voltage $V_{GS5}$ of the transistor M5 ($V_{GS2}=V_{GS5}$).

$$V_{OUT}-V_{REF}=V_{GS6}-V_{GS5}=V_{GS1}-V_{GS2}=V_{IN}$$

is valid, and hence the output voltage $V_{OUT}$ is expressed by the following equation:

$$V_{OUT}=V_{REF}+V_{IN} \tag{18}$$

A multiplier circuit, employing the voltage summation circuit of FIG. 4 as an input circuit, is shown in FIG. 5 (see FIG. 6 of Patent Document 1). It should be noted that, with this active voltage summation circuit, the high frequency operation is restricted by the cut-off frequency fT of the p-channel transistor. It is thus necessary to take the frequency characteristic into consideration. It should also be noted that, with the multiplier circuit, proposed by Bult, a=1/2 and b=c=1. The in-depth analysis in case of integration of the circuit in question may be found in a Wang's thesis. Briefly, there is proposed a multiplier circuit making use of three MOS differential pairs as an input circuit. These three MOS differential pairs perform the role of two voltage summation circuits shown in FIG. 4.

It may be surmised that the circuit is possibly not meritorious because it makes use of a number of MOS differential pairs greater by one than in the case of the circuit proposed by the present inventor (FIG. 5).

[Patent Document 1] Japanese Patent No. 2671872

[Non-Patent Document 1] K. Kimura "An MOS Four-Quadrant Analog Multiplier Based on the Multitail Technique Using a Quadritail Cell as a Multiplier Core", IEEE Transactions on Circuits and Systems-I, Vol. 42, No. 8, pp. 448-454, August 1995

SUMMARY OF THE DISCLOSURE

The entire contents disclosed in the Patent Document 1 and the Non-Patent Document 1 are to be incorporated by reference herein. The following analysis is given by the present inventor.

It is the current that is output from the multiplier of the above-described Patent Document 1. Hence, a resistor needs to be added to the load to obtain an output voltage.

This raises a problem that the characteristic is affected by increased fabrication variations attributable to addition of resistor fabrication variations.

Thus, a first problem is the increased fabrication variations brought about by the use of a resistor load in an output.

A second problem is the temperature characteristic at the output. The reason is that the output current depends on a transconductance parameter β.

The present inventor has recognized the importance of implementing a multiplier circuit with small fabrication variations, while allowing for facilitated temperature compensation, and which may be formed to advantage on a semiconductor integrated circuit.

According to the present invention, there is provided a multiplier circuit including two squaring circuits receiving a differential sum voltage and a differential subtraction voltage of a first input voltage and a second input voltage. The differential sum voltage and the differential subtraction voltage are generated respectively by a voltage summation circuit and a voltage subtraction circuit both of which are supplied with the first and second input voltages. Outputs of the two squaring circuits become terminal voltages of two diode-connected MOS transistors, and a differential voltage between the two terminal voltages corresponds to a product of the first and second input voltages. Each of the two squaring circuits is connected in cascode to each of the diode-connected MOS transistors.

In one embodiment of the present invention, there are provided fifth and sixth MOS differential pairs ((M9, M10) and (M11, M12)), which are common to the voltage summation circuit and the voltage subtraction circuit receive the second input voltage.

The voltage summation circuit includes first and second MOS differential pairs ((M1, M2) and (M3, M4)) which respectively receive the first input voltage (Vx).

The voltage subtraction circuit includes third and fourth MOS differential pairs ((M5, M6) and (M7, M8)) respectively receiving the first input voltage (Vx).

In the voltage summation circuit, a positive phase signal of the first input voltage (Vx) is supplied to a gate of one MOS transistor (M1) of the first MOS transistor pair (M1, M2) and the other MOS transistor (M2) of the first MOS transistor pair is diode-connected to form a positive phase output terminal, and a reverse phase signal of the first input voltage (Vx) is supplied to a gate of one MOS transistor (M3) of the second MOS transistor pair (M3,M4) and the other MOS transistor (M4) of the second MOS transistor pair is diode-connected to form a reverse phase output terminal.

In the voltage subtraction circuit, a positive phase signal of the first input voltage (Vx) is supplied to a gate of one MOS transistor (M5) of the third MOS transistor pair (M5, M6) and the other MOS transistor (M6) of the third MOS transistor pair (M5, M6) is diode-connected to form a positive phase output terminal and a reverse phase signal of the first input voltage (Vx) is supplied to a gate of one MOS transistor (M7) of the fourth MOS transistor pair (M7, M8) and the other MOS transistor (M8) of the fourth MOS transistor pair (M7, M8) is diode-connected to form a reverse phase output terminal.

A positive phase signal of the second input voltage (Vy) is supplied to a gate of one MOS transistor (M9) of the fifth MOS transistor pair (M9, M10) and a common mode voltage ($V_{CM}$) of the second input voltage (Vy) is supplied to a gate of the other MOS transistor (M10) of the fifth MOS transistor pair (M9, M11). A reverse phase signal of the second input voltage (Vy) is supplied to a gate of one MOS transistor (M11) of the sixth MOS transistor pair (M11, M12) and a common mode voltage ($V_{CM}$) is supplied to a gate of the other MOS transistor (M12) of the sixth MOS transistor pair (M11, M12).

Currents flowing through the one MOS transistors (M9, M11) of the fifth and sixth MOS differential pairs, which receive the positive and reverse phase signals of the second input voltage (Vy), are supplied via first and second current mirror circuits ((M13, M17), and (M14, M19)), respectively, to positive and reverse phase terminals of the voltage summation circuit, respectively. Currents flowing through the other transistors (M10, M12) of the fifth and sixth MOS differential pairs, which receive the common mode voltage ($V_{CM}$) of the second input voltage (Vy), are supplied via third and fourth current mirror circuits ((M15, M18), and (M16, M20)), respectively, to positive and reverse phase terminals of the voltage subtraction circuit, respectively.

In the present invention, there is provided a multiplier circuit which includes a voltage summation circuit which receives a first input voltage and a second input voltage and produces a differential sum voltage of the first and second input voltages; first and second MOS differential pairs, which respectively receives the differential sum voltage and a common mode voltage; third and fourth MOS differential pairs, which respectively receive the first input voltage and the second input voltage, a first diode-connected MOS transistor to which the first and second MOS differential pairs are cascode-connected in common; an a second diode-connected MOS transistor to which the third and fourth MOS differential pairs are cascode-connected in common. A differential voltage between a terminal voltage of the first diode-connected MOS transistor and a terminal voltage of the second diode-connected MOS transistor corresponds to a product of the first and second input voltages.

In one embodiment of the present invention, the voltage summation circuit includes first and second MOS differential pairs ((M1, M2) and (M3, M4)) respectively receiving the first input voltage (Vx) and third and fourth MOS differential pairs ((M5, M6) and (M7, M8)) respectively receiving the second input voltage (Vy). A positive phase signal of the first input voltage (Vx) is supplied to a gate of one MOS transistor (M1) of the first MOS transistor pair and the other MOS transistor (M2) of the first MOS transistor pair is diode-connected to form a positive phase output terminal.

A reverse phase signal of the first input voltage (Vx) is supplied to a gate of one MOS transistor (M3) of the second MOS transistor pair and the other MOS transistor (M4) of the second MOS transistor pair is diode-connected to form a reverse phase output terminal.

A positive phase signal of the second input voltage (Vy) is supplied to a gate of one MOS transistor (M6) of the third MOS transistor pair and a common mode voltage ($V_{CM}$) is supplied to a gate of the other MOS transistor (M5) of the third MOS transistor pair;

A reverse phase signal of the second input voltage (Vy) is supplied to a gate of one MOS transistor (M7) of the fourth MOS transistor pair and the common mode voltage ($V_{CM}$) is supplied to a gate of the other MOS transistor (M8) of the fourth MOS transistor pair.

Currents flowing through the one MOS transistors (M6, M7) of the third and fourth MOS differential pairs, which receive the positive and reverse phase signals of the second input voltage (Vy), are supplied via first and second current mirror circuits ((M9, M11) and (M10, M12)), respectively, to positive and reverse phase terminals of the voltage summation circuit, respectively.

According to the present invention, the manufacture tolerance may be decreased because the multiplier circuit of the present invention is constructed without using resistor devices.

According to the present invention, the temperature characteristic may be canceled because the output voltage is not dependent on the transconductance parameter β.

Still other features and advantages of the present invention will become readily apparent to those skilled in this art from the following detailed description in conjunction with the accompanying drawings wherein only the preferred embodiments of the invention are shown and described, simply by way of illustration of the best mode contemplated of carrying out this invention. As will be realized, the invention is capable of other and different embodiments, and its several details are capable of modifications in various obvious respects, all without departing from the invention. Accordingly, the drawing and description are to be regarded as illustrative in nature, and not as restrictive.

PREFERRED MODES OF THE INVENTION

Figure 6:
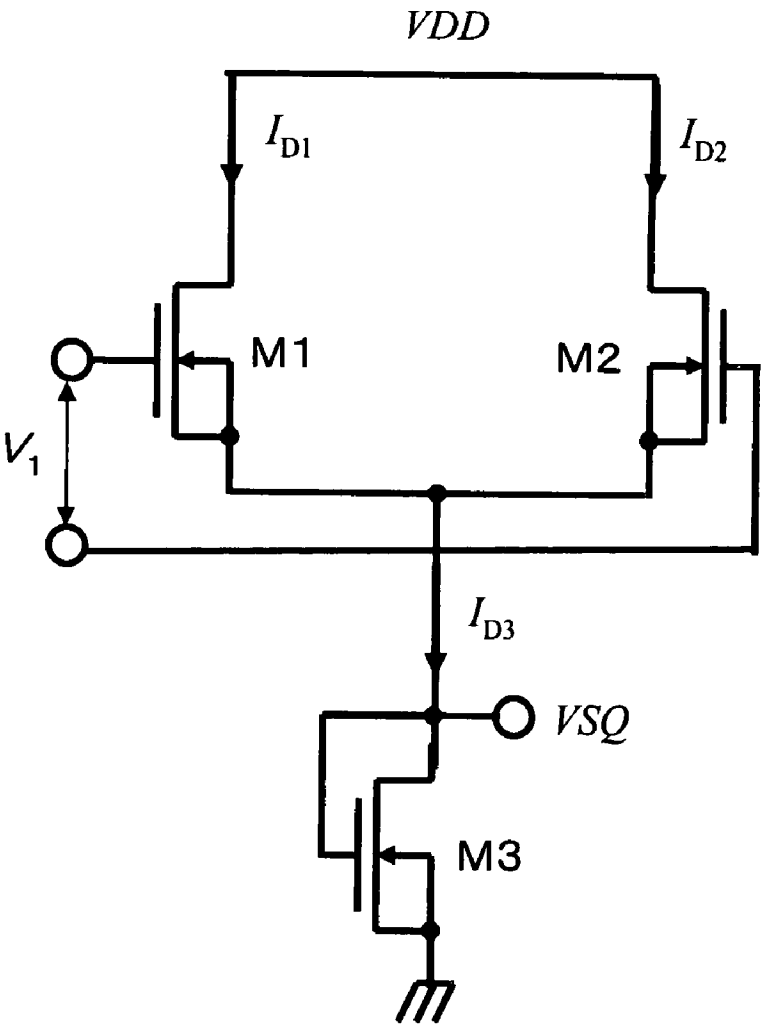
FIG. 6 is a circuit diagram showing the configuration of a squaring circuit used in a multiplier circuit of the present invention.

FIG. 6 shows the configuration of a squaring circuit used in a multiplier circuit according to an exemplary embodiment of the present invention (corresponding to claim 1). The squaring circuit includes a differential MOS transistor pair (M1, M2) and a MOS transistor M3 as a current source. The sources of the MOS transistors M1 and M2 are coupled together and connected to a drain of the MOS transistor M3. The gates of the MOS transistors M1 and M2 are supplied with $V_{CM}+V_1/2$ and $V_{CM}-V_1/2$, respectively. The gate and the drain of the MOS transistor M3 are coupled together. The drain potential (gate potential) of the MOS transistor M3 represents a squared voltage $V_{SQ}$.

The respective drain currents of the MOS transistors M1, M2 and M3 are represented by the following equations (19) to (21).

$$I_{D1}=\beta(V_{CM}+V_1/2-V_{SQ}-V_{TH})^2 \tag{19}$$

$$I_{D2}=\beta(V_{CM}-V_1/2-V_{SQ}-V_{TH})^2 \tag{20}$$

$$I_{D3}=2\beta(V_{SQ}-V_{TH})^2 \tag{21}$$

where $$I_{D1}+I_{D2}=I_{D3} \tag{22}$$

Solving the above equations with respect to $V_{SQ}$, $$V_{SQ}=\frac{V_{CM}}{2}+\frac{1}{8}\frac{V_1^2}{V_{CM}-2V_{TH}} \tag{23}$$

Thus, a squared value of the differential input voltage $V_1$ has now been found from $V_{SQ}$.

Noteworthy in the equation (23) is the fact that the output voltage $V_{SQ}$ of the squaring circuit is not affected by the transconductance parameter β, with the coefficient of the squared voltage $V_1^2$ being $1/\{8(V_{CM}-2V_{TH})\}$.

Hence, a squaring circuit with a temperature characteristic compensated may be implemented by setting the coefficient so as to be constant with temperature.

It is noted that, with the conventional squaring circuit, the transconductance parameter β is routinely included in the coefficient of the squared voltage $V_1^2$ and hence the transconductance parameter β assumes a negative temperature coefficient, with the output voltage thus exhibiting a negative temperature characteristic.

The operating voltage range of the circuit of FIG. 6 will now be derived.

The conditions under which the currents flow through the MOS transistors M1 and M2, in the equations (19), (20), are $$V_{CM}+V_1/2-V_{SQ}-V_{TH}\geqq 0$$

and $$V_{CM}-V_1/2-V_{SQ}-V_{TH}\geqq 0 \tag{24}$$

Hence, substituting the equation (23) into these equations and solving, $$2(-\sqrt{2}-1)(V_{CM}-2V_{TH})\leqq V_1\leqq 2(\sqrt{2}-1)(V_{CM}-2V_{TH}) \text{ for } V_1\geqq 0 \tag{25}$$

and $$2(1-\sqrt{2})(V_{CM}-2V_{TH})\leqq V_1\leqq 2(\sqrt{2}+1)(V_{CM}-2V_{TH}) \text{ for } V_1\leqq 0 \tag{26}$$

Hence, we obtain $$|V_1|\leqq 2(\sqrt{2}-1)(V_{CM}-2V_{TH}) \tag{27}$$

Figure 7:
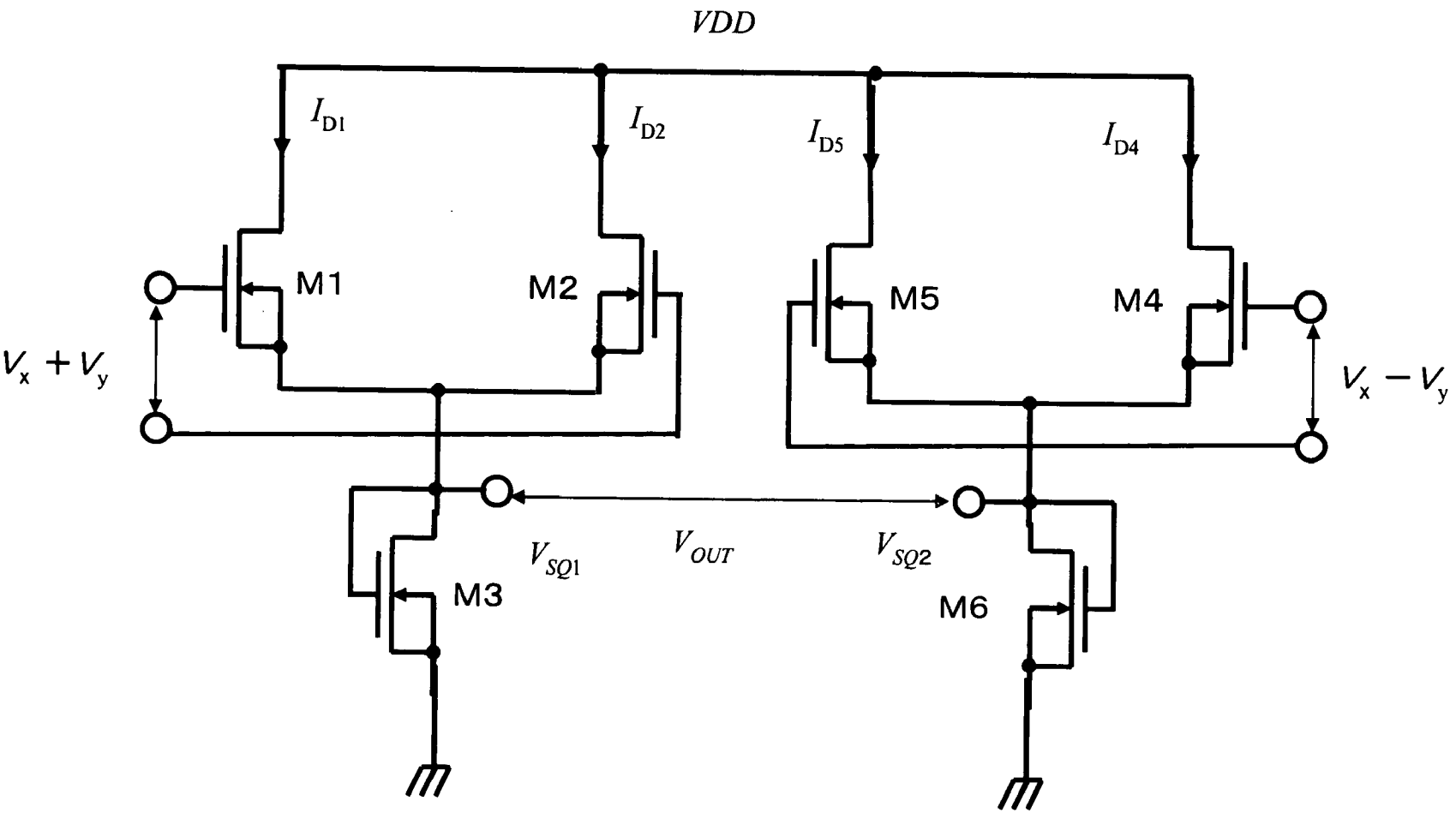
FIG. 7 is a circuit diagram showing the configuration of a multiplier circuit formed by two multiplier circuits of the present invention.

The circuit of FIG. 7 includes two of the squaring circuits shown in FIG. 6. Specifically, the circuit of FIG. 7 includes a MOS differential pair (M1, M2) connected in cascode to a diode-connected current source MOS transistor M3 to form a squaring circuit, and another MOS differential pair (M4, M5), connected in cascode to another diode-connected current source MOS transistor M6 to form the other squaring circuit. The former squaring circuit receives a differential sum voltage ($V_x+V_y$) from the voltage summation circuit, while the latter squaring circuit receives a differential subtraction voltage ($V_x-V_y$) from the voltage subtraction circuit. The drain voltages ($V_{SQ1}$, $V_{SQ2}$) of the diode connected MOS transistors M3, M6 correspond to Vx×Vy.

It is assumed that, in the squaring circuits, the differential input voltage $V_x+V_y$, with a common mode voltage $V_{CM}$, is applied to the MOS differential pair (M1, M2), and the differential input voltage $V_x-V_y$, with a common mode voltage $V_{CM}$, is applied to the MOS differential pair M4 and M5. In this case, the output voltage $V_{SQ1}$ of the squaring circuit may be found by substituting (Vx+Vy) into $V_1$ of the equation (23), whilst the output voltage $V_{SQ2}$ of the other squaring circuit may be found by substituting ($V_x-V_y$) into $V_1$ of the equation (23). The differential output voltage $V_{OUT}(=V_{SQ1}-V_{SQ2})$ may be found by $$V_{OUT}=V_{SQ1}-V_{SQ2}=\frac{1}{2}\frac{V_xV_y}{V_{CM}-2V_{TH}} \tag{28}$$

That is, there is now obtained a product $V_x\times V_y$ of two signals $V_x$ and $V_y$, and hence a multiplier circuit has now been implemented.

Noteworthy in the equation (28) is the fact that the output voltage of the multiplier circuit is not affected by the transconductance parameter β, with the coefficient of the product voltages (multiplication voltages) $V_x$ and $V_y$ being $1/\{2(V_{CM}-2V_{TH})\}$. Hence, the squaring circuits not exhibiting temperature characteristic may be implemented by setting the coefficient so as to be constant with temperature.

It is noted that, with the conventional multiplier circuit, the transconductance parameter β is routinely included in the coefficient of the product voltages (multiplication voltages) $V_x$ and $V_y$ and hence the transconductance parameter β assumes a negative temperature coefficient, with the output voltage thus exhibiting a negative temperature characteristic.

From the equation (27), the operating range of the circuit of FIG. 7 may be expressed by $$|V_x \pm V_y| \leq 2(\sqrt{2}-1)(V_{CM}-2V_{TH}) \quad (29)$$

Figure 8:
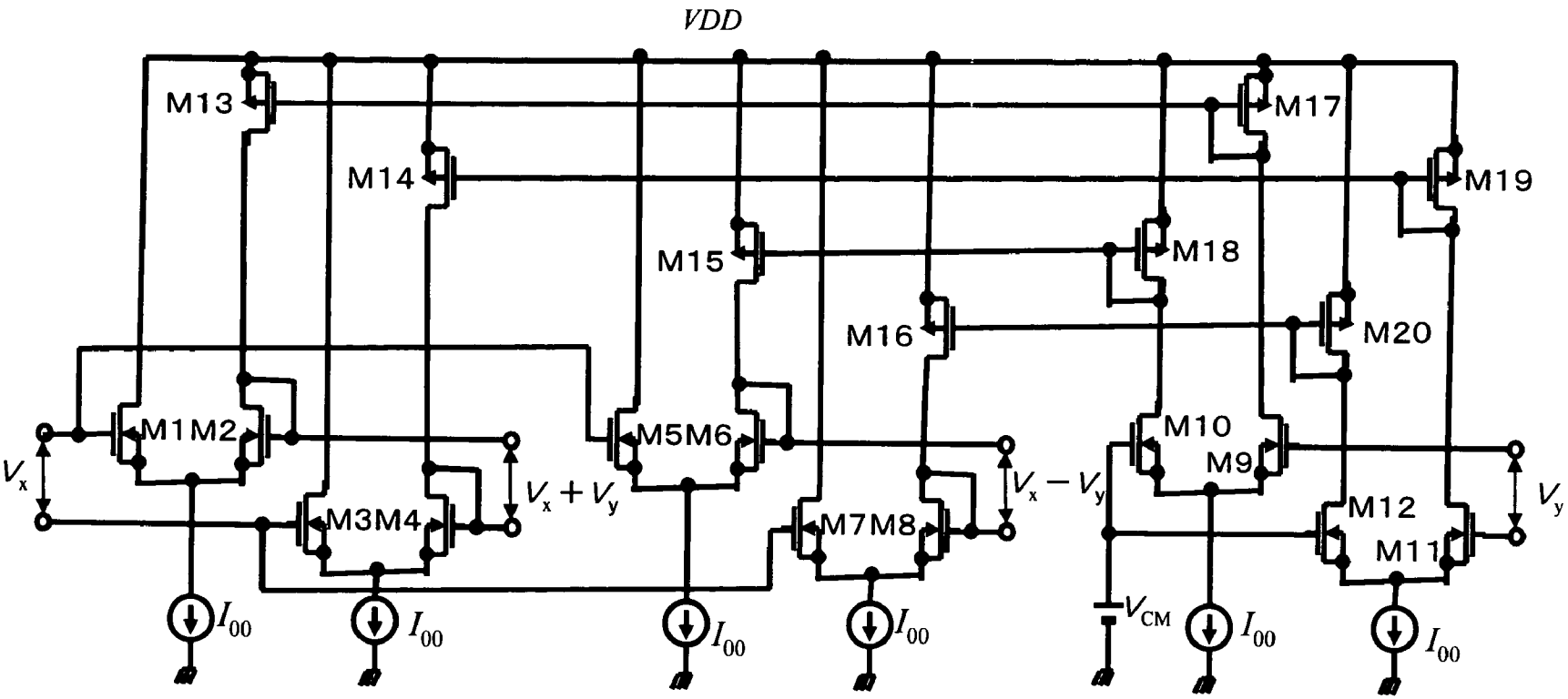
FIG. 8 is a circuit diagram showing a voltage summation circuit and a voltage subtraction circuit used in a multiplier circuit of the present invention.

FIG. 8 shows a voltage summation circuit and a voltage subtraction circuit according to an exemplary embodiment of the present invention (corresponding to claim 2).

The voltage summation circuit includes MOS differential pairs (M1, M2) and (M3, M4) that receives a first input voltage $V_x$, and MOS differentia pairs (M9, M10) and (M11, M12) that receives a second input voltage $V_y$. Specifically, the first input voltage $V_x$ is supplied to the gate of the MOS transistor M1 of the MOS transistor pair (M1, M2) and to the gate of the MOS transistor M3 of the MOS transistor pair (M3, M4). The other transistors M2 and M4 are diode-connected, with the connection node of drain and gate of the transistor M2 forming a positive phase output terminal and with the connection node of drain and gate of the transistor M4 forming a reverse phase output terminal.

The voltage subtraction circuit includes MOS differential pairs (M5, M6) and (M7, M8) that receive a first input voltage $V_x$, and MOS differentia pairs (M9, M10) and (M11, M12) that receive a second input voltage $V_y$. Specifically, the first input voltage $V_x$ is supplied to the gate of the MOS transistor M1 of the MOS transistor pair (M1, M2) and to the gate of the MOS transistor M3 of the MOS transistor pair (M3, M4). The other transistors (M2, M4) are diode-connected, with the connection node of drain and gate of the transistor M2 forming a positive phase output terminal, and with a connection node of the drain and gate of the transistor M4 forming a reverse phase output terminal.

The voltage subtraction circuit includes MOS differential pairs (M5, M6) and (M7, M8), supplied with the first input voltage $V_x$, and the aforementioned MOS differential pairs (M9, M10) and (M11, M12), supplied with the first input voltage $V_y$. It is noted that the voltage subtraction circuit uses the differential pairs (M9, M10) and (M11, M12) in common with the aforementioned voltage summation circuit. The gate of the MOS transistor M5 of the MOS transistor pair (M5, M6) is supplied with the first input voltage $V_x$, while the other MOS transistor M6 is diode-connected, with its connection node of drain and gate forming a positive phase output terminal. The gate of the MOS transistor M7 of the MOS transistor pair (M7, M8) is supplied with the first input voltage $V_x$, while the other MOS transistor M8 is diode-connected, with its connection node of drain and gate forming a reverse phase output terminal.

The gate of the one MOS transistor M9 of the MOS transistor pair (M9, M10), receiving the second input voltage $V_y$, is supplied with the positive phase signal ($V_{CM}+V_y/2$) of the second input voltage $V_y$, whilst the gate of the one MOS transistor M11 of the MOS transistor pair (M11, M12), similarly receiving the second input voltage $V_y$, is supplied with the reverse phase signal ($V_{CM}-V_y/2$) of the second input voltage $V_y$. The gates of the other MOS transistors (M10, M12) are supplied with the common mode voltage $V_{CM}$ of the second input voltage $V_y$.

The mirror current of the drain current of the MOS transistor M9, supplied with the positive phase signal ($V_{CM}+V_y/2$) of the second input voltage $V_y$, is supplied via a first current mirror circuit (M17, M13) to a connection node of drain and gate (positive phase output terminal) of the MOS transistor M2 of the voltage summation circuit (M2, M4). In similar manner, the mirror current of the drain current of the MOS transistor M11, supplied with the reverse phase signal ($V_{CM}-V_y/2$) of the second input voltage $V_y$, is supplied via a second current mirror circuit (M19, M14) to a connection node of drain and gate (reverse phase output terminal) of the MOS transistor M4 of the voltage summation circuit.

The mirror current of the drain current of the MOS transistor M10, receiving the common mode voltage $V_{CM}$ of the second input voltage $V_y$, is supplied via a third current mirror circuit (M18, M15) to a drain-gate connection node (positive phase output terminal) of the MOS transistor M6 of the voltage subtraction circuit. In similar manner, the mirror current of the drain current of the MOS transistor M12, similarly receiving the common mode voltage $V_{CM}$ of the second input voltage $V_y$, is supplied via a fourth current mirror circuit (M20, M16) to a drain-gate connection node (reverse phase output terminal) of the MOS transistor M8 of the voltage subtraction circuit.

From the connection nodes of drain and gates (positive phase and reverse phase output terminals) of the MOS transistors M2 and M4 is differentially output a voltage summation value of the first input voltage $V_x$ (differential input voltage) and the second input voltage $V_y$ (differential input voltage), that is, $V_x+V_y$. From the connection nodes of drain and gates (positive phase and reverse phase output terminals) of the MOS transistors (M6, M8) is differentially output a voltage subtraction value of the first input voltage (differential input voltage) $V_x$ and the second input voltage $V_y$ (differential input voltage), that is, $V_x-V_y$.

Figure 1:
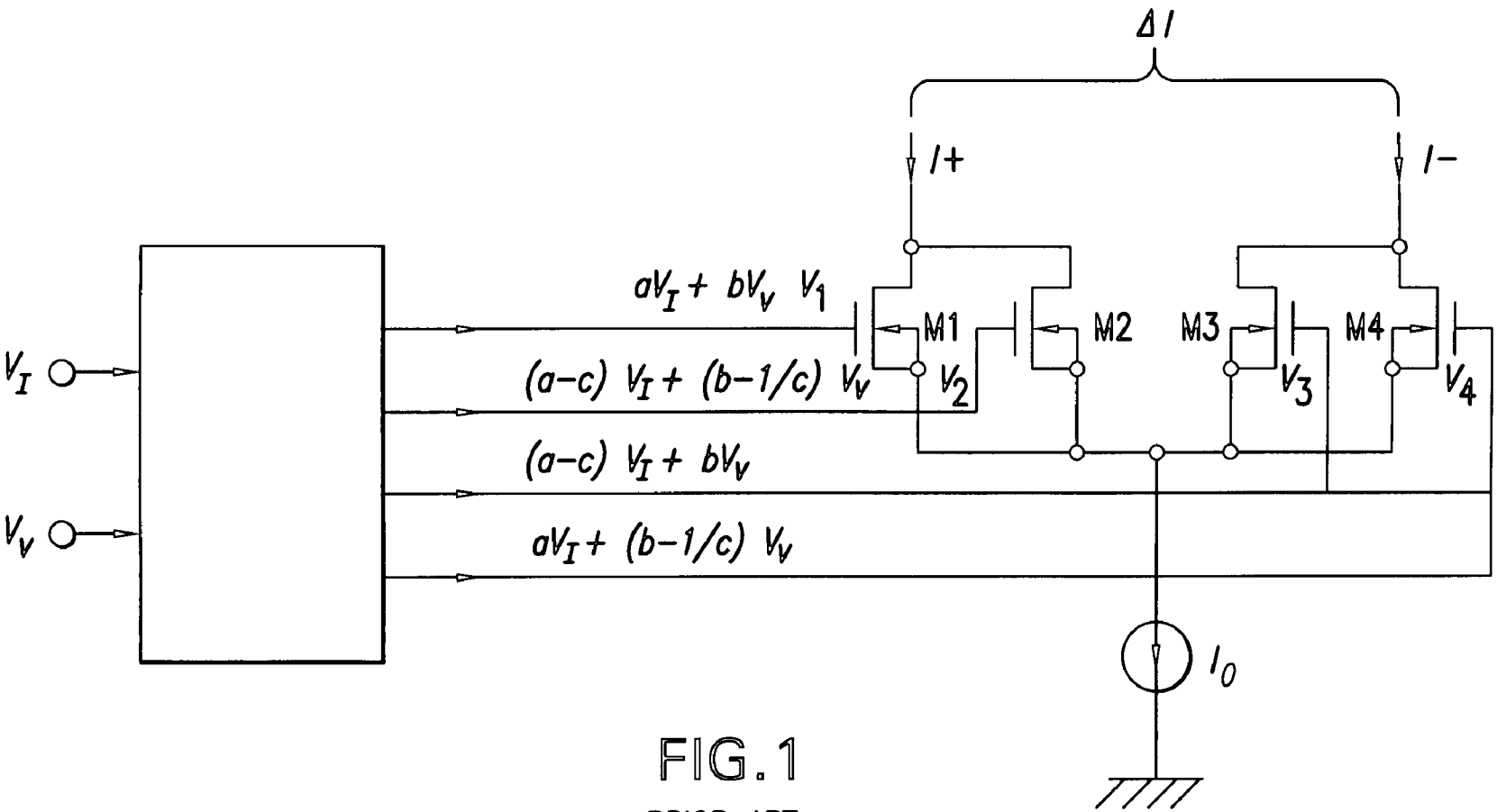
FIG. 1 PRIOR ART
FIG. 1 is a diagram showing the configuration of a conventional multiplier core circuit formed by a conventional quadritail cell.
Figure 2:
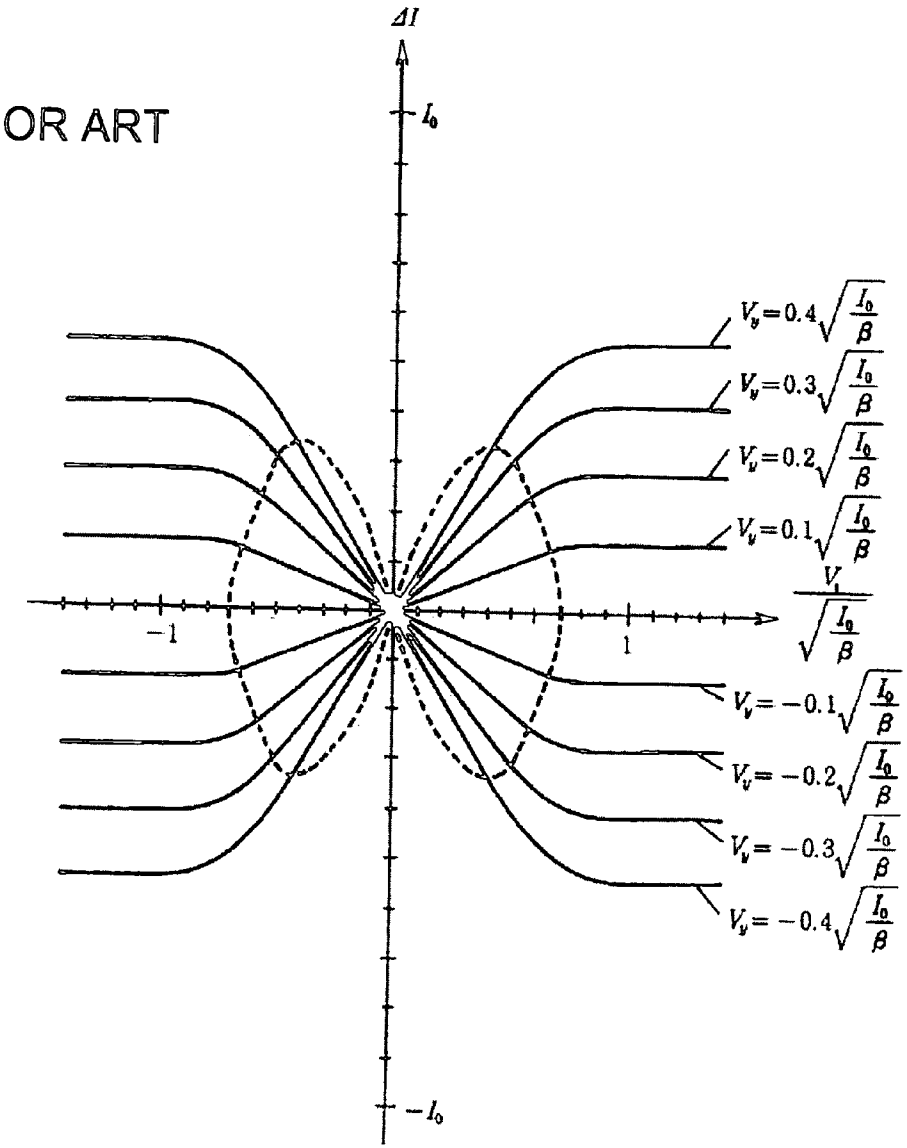
PRIOR ART FIG.2
FIG. 2 is a diagram showing differential output current characteristics of a conventional multiplier core circuit formed by a conventional quadritail cell.
Figure 3:
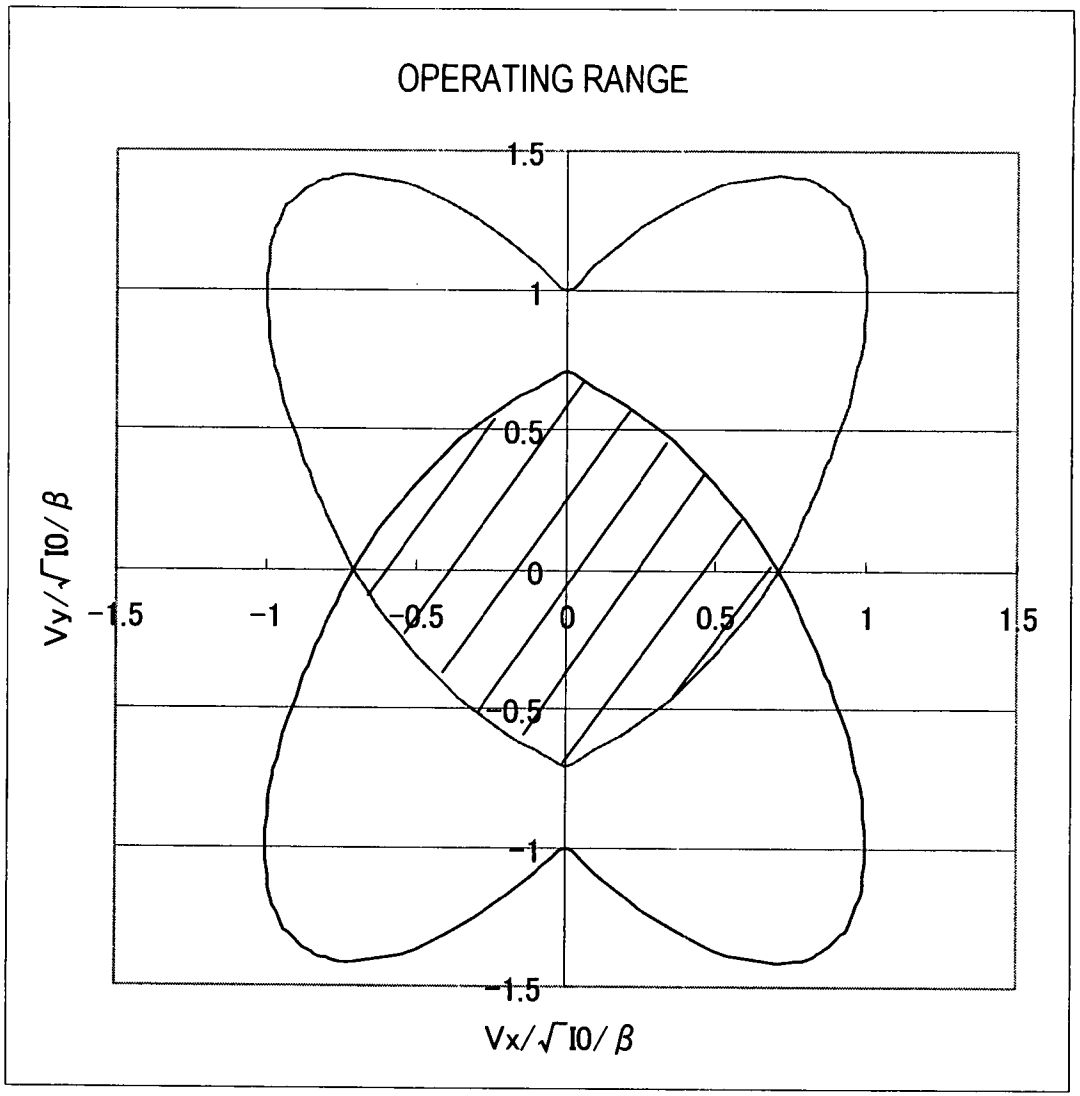
FIG.3 RELATED ART
FIG. 3 is a diagram showing an operating range of a conventional multiplier core circuit formed by a conventional quadritail cell.
Figure 4:
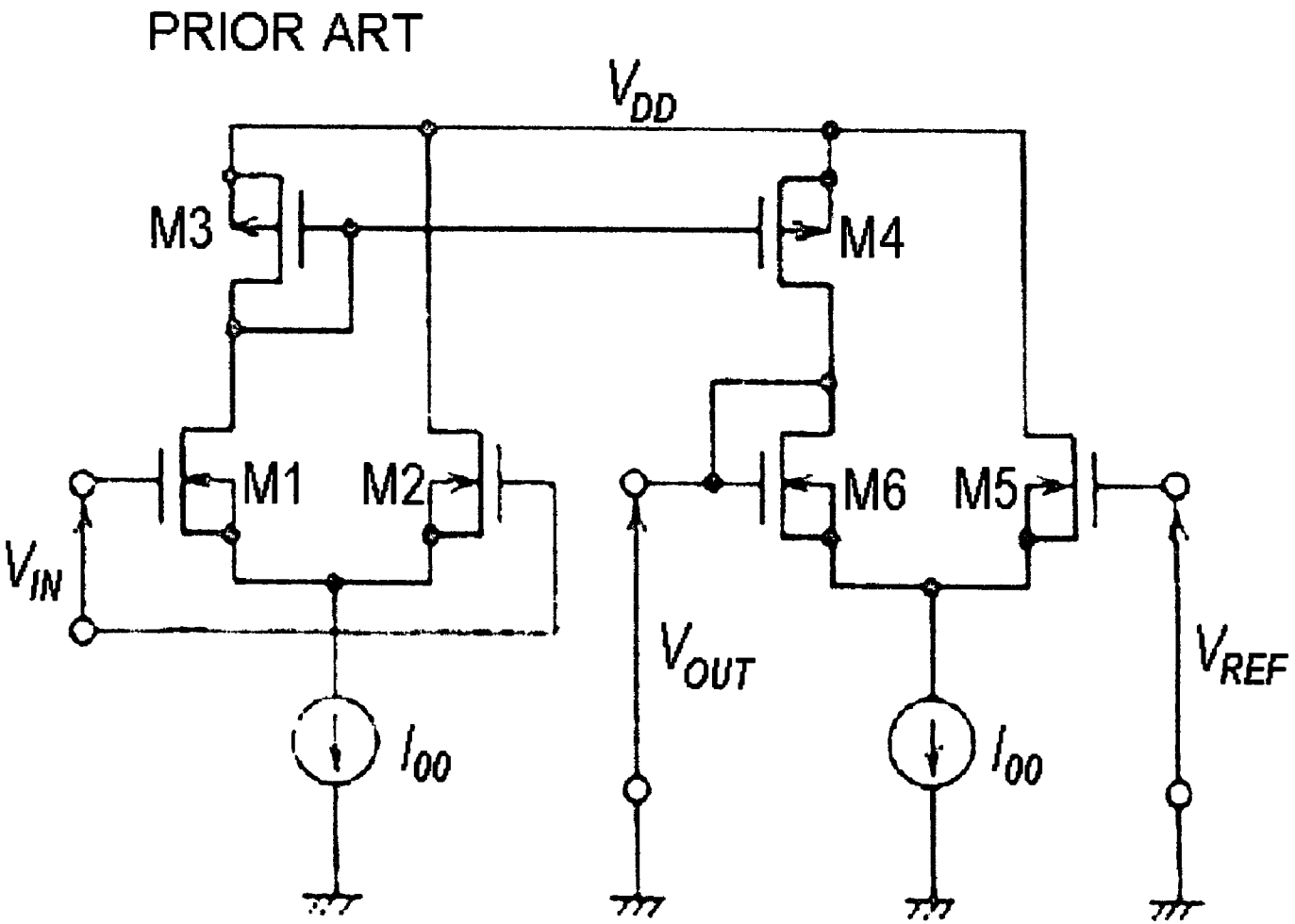
FIG. 4 is a circuit diagram showing the configuration of a conventional voltage summation circuit.
Figure 5:
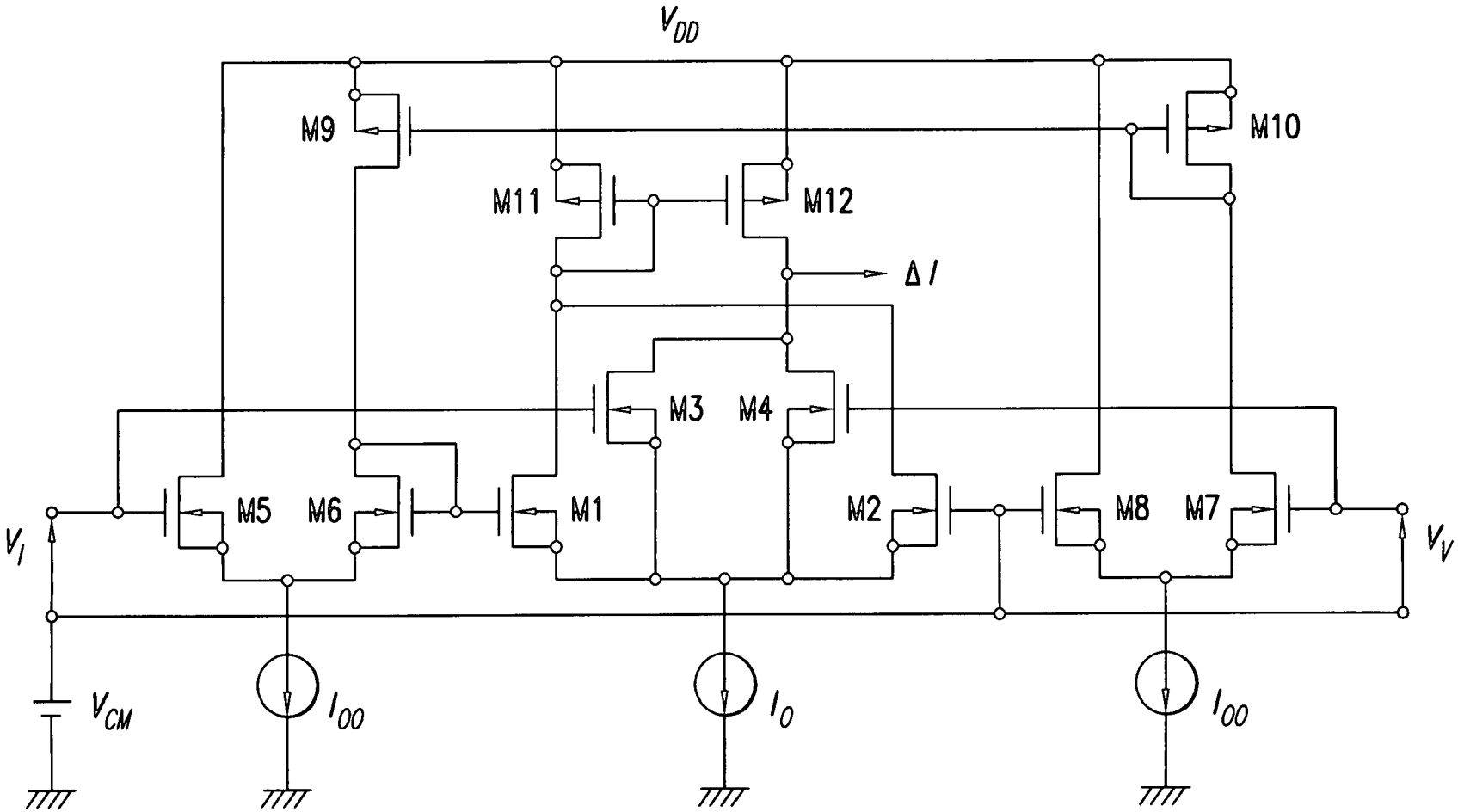
FIG. 5 PRIOR ART
FIG. 5 is a circuit diagram showing the configuration of a conventional multiplier circuit.
Figure 9:
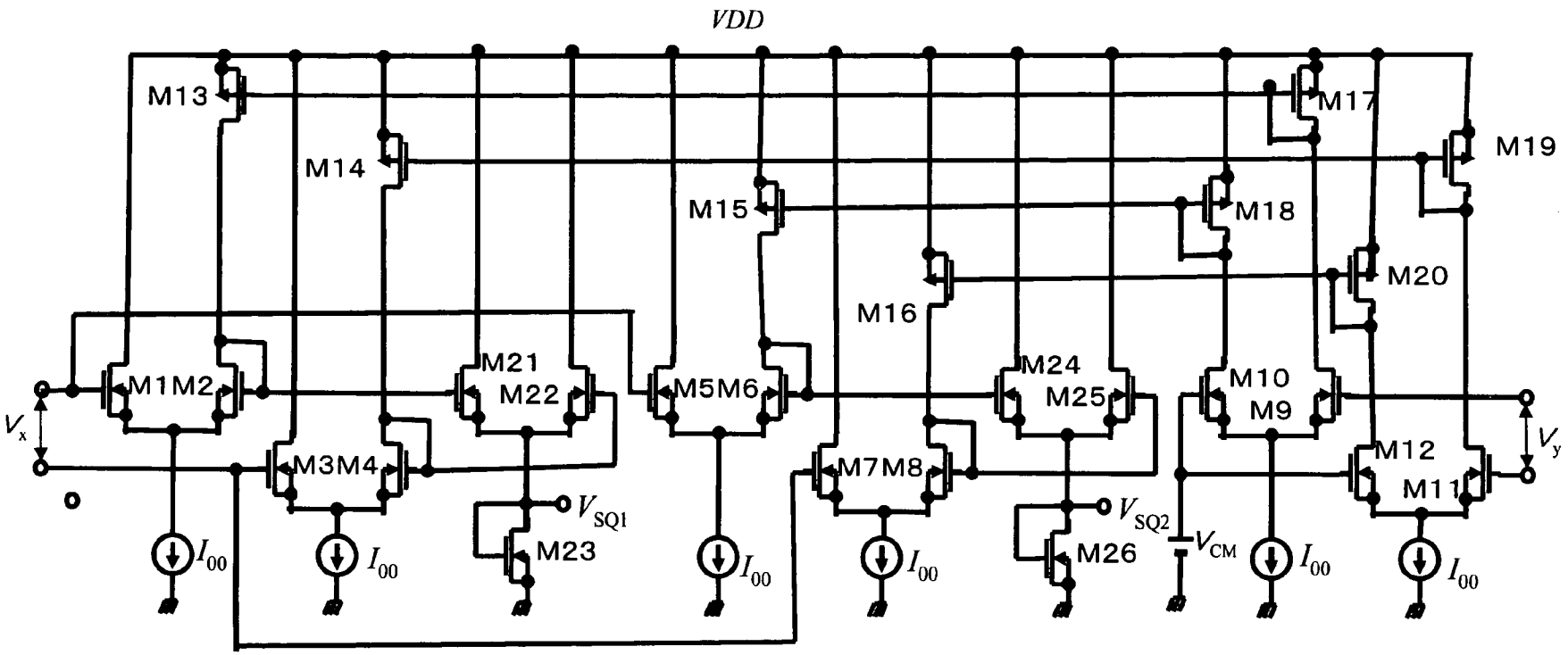
FIG. 9 is a circuit diagram showing the configuration of a multiplier circuit formed by a voltage summation circuit and a voltage subtraction circuit according to the present invention.

FIG. 9 shows a circuit configuration of an example of a multiplier circuit according to claim 1. The voltage summation circuit, making use of MOS differential pairs, is formulated as shown in FIG. 4. Referring to FIG. 9, differential pairs (M1, M2), (M3, M4), (M10, M9) and (M11, M12) and current mirror circuits (M17, M13), (M19, M14) are the same as the corresponding components of the voltage summation circuits of FIG. 8. The differential pair (M21, M22) and the diode-connected MOS transistor M23 correspond to the squaring circuit of FIG. 6 composed of the differential pair (M1, M2) and the diode-connected MOS transistor M3. The voltage summation circuit and the squaring circuit output, at a drain-gate connection terminal $V_{SQ1}$ of the MOS transistor M23, a voltage proportionate to the square of the output voltage of the voltage summation circuit ($V_x+V_y$), that is, the sum of the voltage at the drain gate connection terminal of the MOS transistor M2 and that at the drain gate connection terminal of the MOS transistor M4, or $(V_x+V_y)^2$, in accordance with the equation (23).

The differential pairs (M5, M6), (M7, M8), (M10, M9) and (M11, M12) and current mirror circuits (M18, M15) and (M20, M16) correspond to the voltage summation circuits of FIG. 8. The differential pair (M24, M25) and the diode-connected MOS transistor M26 correspond to the squaring circuit of FIG. 6 composed of the differential pair (M1, M2) and the diode-connected MOS transistor M3. The voltage summation circuit and the squaring circuit output, at a drain-gate connection terminal $V_{SQ2}$ of the MOS transistor M26, a voltage proportionate to the square of the output voltage of the voltage subtraction circuit ($V_x-V_y$), that is, the differential voltage between the drain-gate connection terminal of the MOS transistor M6 and the drain-gate connection terminal of the MOS transistor M8, or $(V_x-V_y)^2$.

Since the squaring circuit according to the present embodiment is in need of differential input voltages, two sets of the voltage summation circuit of FIG. 4 are used to generate a differential output voltages, as shown in FIGS. 8 and 9.

Referring to FIG. 8, $$V_{IN}=V_{CM}+V_y/2 \text{ and}$$

$$V_{IN}'=V_{CM}-V_y/2$$

are supplied to the gates of the one MOS transistors M9 and M11 of the MOS differential pairs (M9, M10) and (M11, M12) of the two voltage summation circuits. The common mode voltage $V_{CM}$ is supplied to the gates of the other MOS transistors M10 and M12 of the MOS differential pairs (M9, M10) and (M11, M12).

To the gates of the one MOS transistors M1 and M3 of the MOS differential pairs (M1, M2) and (M3, M4) are supplied $$V_{REF}=V_{CM}+V_x/2$$

and $$V_{REF}'=V_{CM}-V_x/2$$

where $V_{CM}$ is the common mode voltage of $V_x$. Then, at the positive phase output terminal of the other MOS transistor M2 of the MOS transistor pair (M1, M2), that is, at the connection node of drain and gate of the MOS transistor M2, and at the reverse phase output terminal of the of the other MOS transistor M4 of the MOS transistor pair (M3, M4), that is, at the connection node of drain and gate of the MOS transistor M4, there are presented voltages $V_{OUT}$ and $V_{OUT}$, such that $$V_{OUT}=2V_{CM}+V_x/2+V_y/2$$

and $$V_{OUT}'=2V_{CM}-V_x/2-V_y/2$$

thus producing a differential output voltage (differential sum voltage)

$$V_{OUT\text{-}OUT}'=V_x+V_y.$$

A voltage subtraction circuit may be implemented by using two sets of voltage summation circuits shown in FIG. 4, thus enabling the differential output voltage to be produced. It is noted that, in this case, the voltages VREF and VREF', applied to the voltage summation circuits, are interchanged. To the one transistors M5, M7 of the MOS differential pairs (M5, M6) and (M7, M8) are respectively supplied $V_{CM}+V_x/2$ and $V_{CM}-V_x/2$. Then, at the positive phase output terminal of the other MOS transistor M6, that is, at the connection node of drain and gate of the MOS transistor M6, and at the reverse phase output terminal of the other MOS transistor M8, that is, at the connection node of drain and gate of the MOS transistor M8, there are presented voltages $V_{OUT}$ and $V_{OUT}$, such that $$V_{OUT}=2V_{CM}+V_x/2-V_y/2$$

and $$V_{OUT}'=2V_{CM}-V_x/2+V_y/2$$

thus producing a differential output voltage (differential subtraction voltage) $V_{OUT\text{-}OUT}'=V_x-V_y$.

Comparing the voltage summation circuit and the voltage subtraction circuit, thus obtained, it is seen that, with the $V_y$ input side and the $V_y$ output side remaining as they are, the $V_x$ input side (MOS differential pairs M9, M10 and M11, M12) and the current mirror input side (M17, M19, M18 and M20) may be used in common by the voltage summation circuit and the voltage subtraction circuit. That is, the currents of the same value as those flowing through respective transistors of the two differential pairs on the $V_x$ input side are supplied to respective four output terminals by the current mirror circuits, as shown in FIG. 8. This may dispense with two differential pairs.

The operating ranges of the voltage summation circuit and the voltage subtraction circuit are equal to that of the MOS differential pair, such that $$|V_x \pm V_y| \le \sqrt{\frac{I_{00}}{\beta}} \tag{30}$$

The operating range is maximum in case the right sides of the equations (29) and (30) are set so as to be equal to each other. That is, It is then sufficient to set:

$$2(\sqrt{2}-1)(V_{CM}-2V_{TH})=\sqrt{\frac{I_{00}}{\beta}} \tag{31}$$

Figure 10:
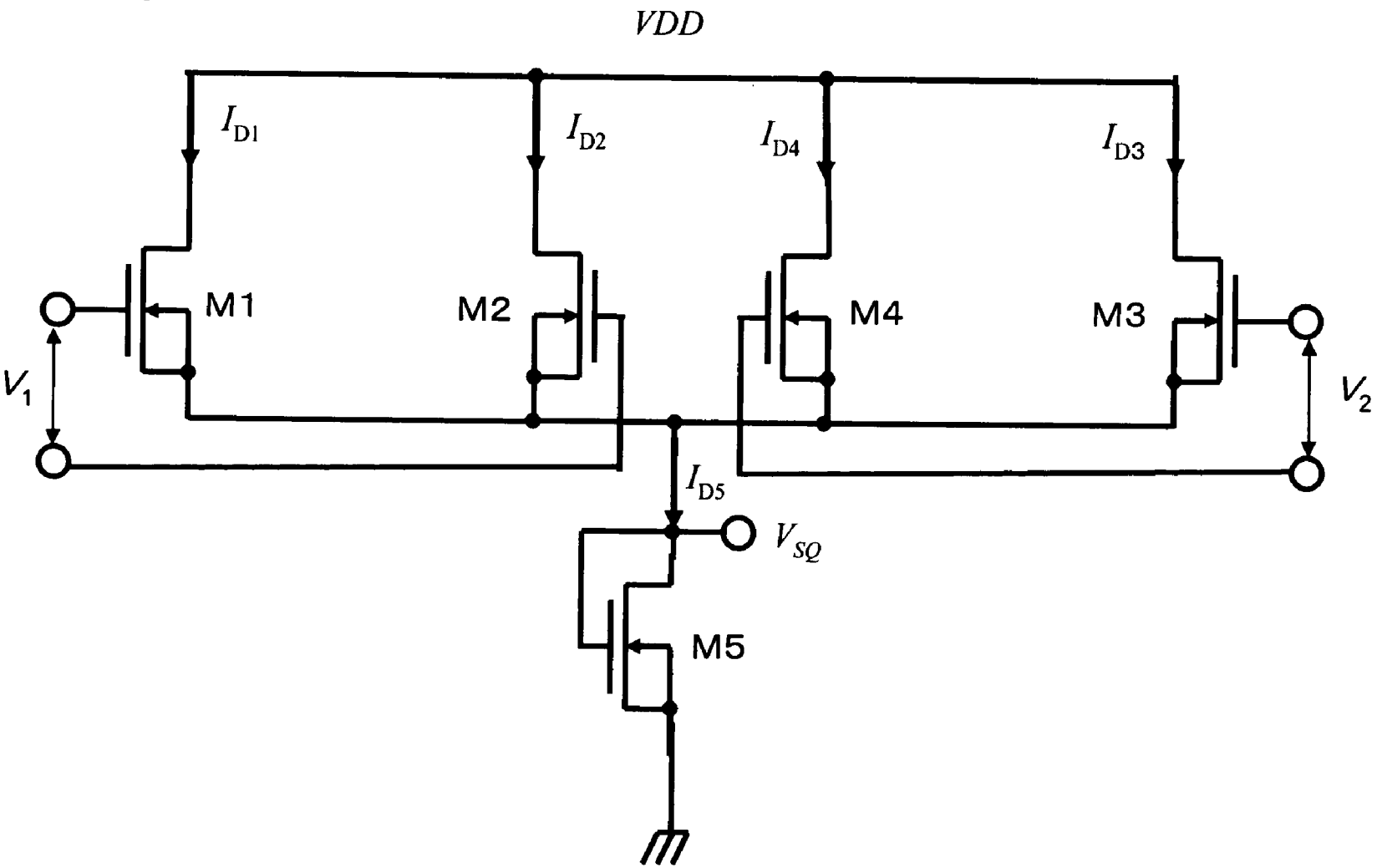
FIG. 10 is a circuit diagram showing the configuration of a squaring summation circuit used in the multiplier circuit of the present invention.

FIG. 10 shows a circuit configuration of a squaring summation circuit used in the multiplier circuit according to another exemplary embodiment of the present invention (corresponding to claim 3). The squaring circuit includes a diode-connected current source MOS transistor 5 and two MOS transistor pairs (M1, M2) and (M3, M4), both connected to the drain of the current source MOS transistor 5 and having sources coupled together. A first voltage $V_1$ is differentially supplied to the gates of the MOS differential pair (M1, M2), whilst a second voltage $V_2$ is differentially supplied to the gates of the MOS differential pair (M3, M4).

The drain currents $I_{D1}$ to $I_{D4}$ of the MOS transistor pairs (M1, M2) and (M3, M4), making up the input pair, may be expressed by the following equations:

$$I_{D1}=\beta(V_{CM}+V_1/2-V_{SQ}-V_{TH})^2 \tag{32}$$

$$I_{D2}=\beta(V_{CM}-V_1/2-V_{SQ}-V_{TH})^2 \tag{33}$$

$$I_{D3}=\beta(V_{CM}+V_2/2-V_{SQ}-V_{TH})^2 \tag{34}$$

$$I_{D4}=\beta(V_{CM}-V_2/2-V_{SQ}-V_{TH})^2 \tag{35}$$

$$I_{D5}=4\beta(V_{SQ}-V_{TH})^2 \tag{36}$$

It is noted that $$I_{D1}+I_{D2}+I_{D3}+I_{D4}=I_{D5} \tag{37}$$

so that, solving the above equations, we obtain $$V_{SQ}=\frac{V_{CM}}{2}+\frac{1}{16}\frac{V_1^2+V_2^2}{V_{CM}-2V_{TH}} \tag{38}$$

and hence the sum of the squared values of the differential input voltages.

Noteworthy in the equation (38) is the fact that the output voltage of the squaring summation circuit is not affected by the transconductance parameter β, with the coefficient of the square sum voltage $(V_1^2+V_2^2)$ being $1/\{16(V_{CM}-2V_{TH})\}$. A squaring summation circuit with a temperature characteristic compensated, may be implemented by setting the coefficient so as to be constant with temperature.

It was customary with the conventional squaring summation circuit that the coefficient of the square sum voltage $(V_1^2+V_2^2)$ is affected by the transconductance parameter β, and that, since this transconductance parameter has negative transconductance characteristics, the output voltage exhibits a negative temperature characteristic. The operating voltage range will now be derived.

In the equations (32) to (35), the conditions under which currents flow through the MOS transistors M1, M2, M3 and M4 are such that $$V_{CM}+V_1/2-V_{SQ}-V_{TH},\ V_{CM}-V_1/2-V_{SQ}-V_{TH}\geqq 0 \tag{39}$$

and $$V_{CM}+V_2/2-V_{SQ}-V_{TH},\ V_{CM}-V_2/2-V_{SQ}-V_{TH}\geqq 0 \tag{40}$$

Thus, substituting the equation (38) and solving, we obtain $$|V_1|\leqq 4(V_{CM}-2V_{TH})-\sqrt{24(V_{CM}-2V_{TH})-V_2^2} \tag{41}$$

$$|V_2|\leqq 4(V_{CM}-2V_{TH})-\sqrt{24(V_{CM}-2V_{TH})-V_1^2} \tag{42}$$

Thus, putting $V_1=0$ in the equation (41), the operating range ($V_1$, $V_2$) may be found as $$V_1=\pm 2(\sqrt{6}-2)(V_{CM}-2V_{TH})$$

Figure 11:
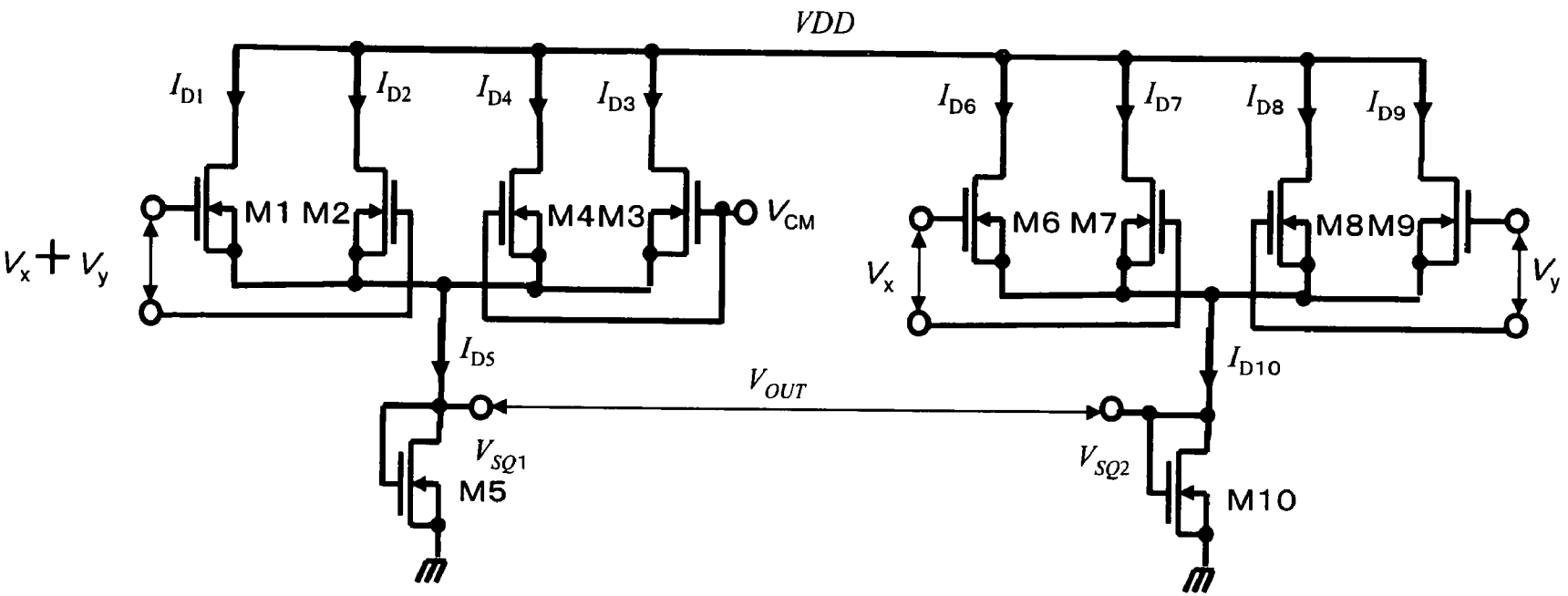
FIG. 11 is a circuit diagram showing the configuration of a multiplier circuit formed by two squaring summation circuits according to the present invention.

Referring to FIG. 11, a differential input voltage $V_x+V_y$, with the common mode voltage for both being $V_{CM}$, and the common mode voltage $V_{CM}$, are applied to a squaring summation circuit of FIG. 10 composed of the differential pairs (M1, M2) and (M3, M4) and a current source M5. In similar manner, a differential input voltage $V_x$ and a differential input voltage $V_y$, with the common mode voltage for both being $V_{CM}$, are applied to a squaring summation circuit of FIG. 10 composed of the differential pairs (M6, M7) and (M8, M9) and a current source M10. A differential output voltage $V_{OUT}$ of the outputs $V_{SQ1}$ and $V_{SQ2}$ of the two squaring summation circuits may then be found as $$V_{OUT}=V_{SQ1}-V_{SQ2}=\frac{1}{8}\frac{V_xV_y}{V_{CM}-2V_{TH}} \tag{43}$$

whereby a product $V_x\times V_y$ of the two signals $V_x$ and $V_y$ is found. So, a multiplier circuit has now been implemented.

Noteworthy in the equation (43) is the fact that the output voltage of the multiplier circuit is not affected by the transconductance parameter β, with the coefficient of the product voltage (multiplication voltage) $V_x\times V_y$ being $1/\{8(V_{CM}-2V_{TH})\}$. Hence, a squaring circuit with a temperature characteristic compensated may be implemented by setting the coefficient so as to be constant with temperature.

It is noted that, with the conventional multiplier circuit, the transconductance parameter β is routinely included in the coefficient of the product voltage (multiplication voltage) $V_x\times V_y$, as shown in FIG. 17, and the transconductance parameter β assumes a negative temperature coefficient, with the output voltage thus exhibiting a negative temperature characteristic.

Figure 12:
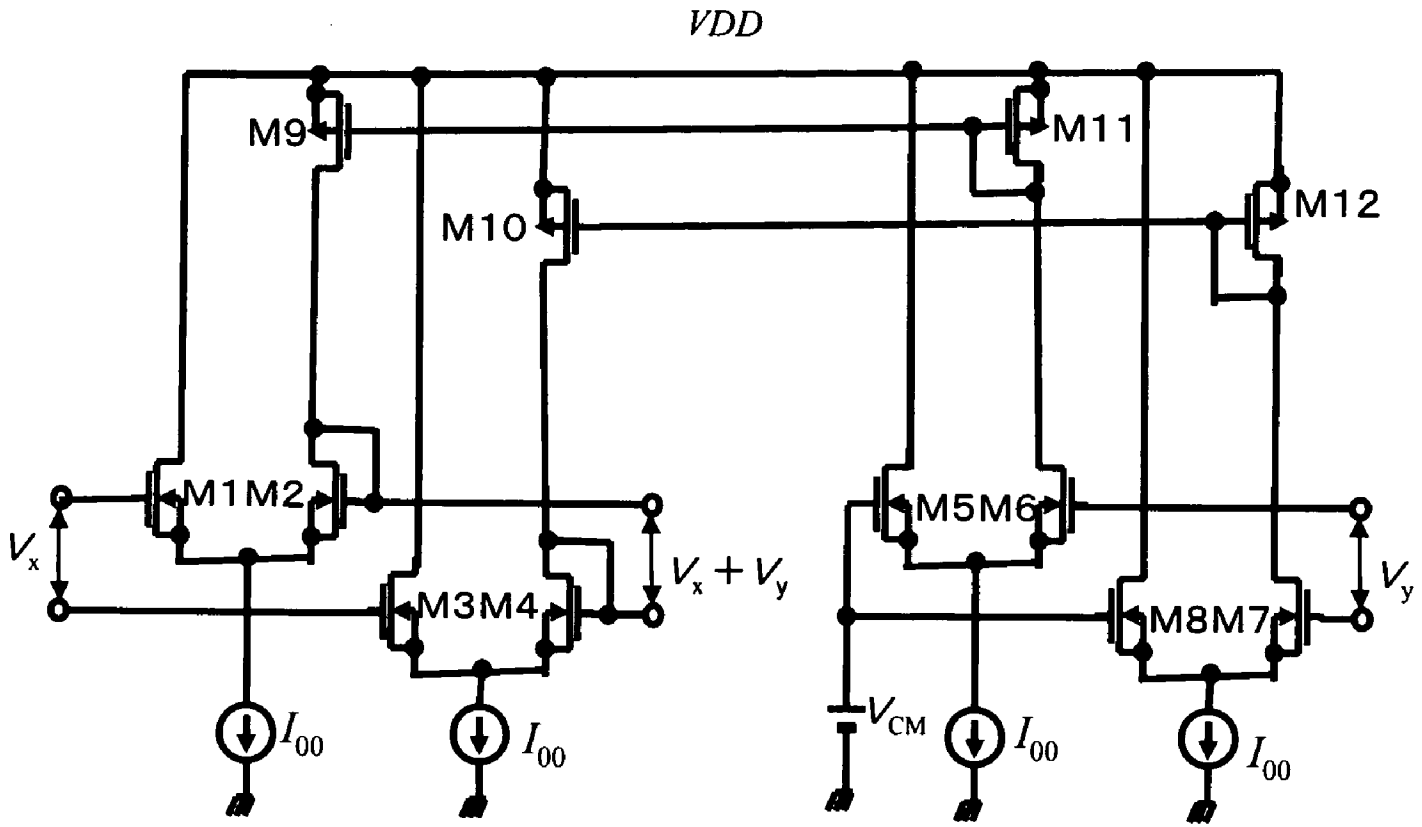
FIG. 12 is a circuit diagram showing the configuration of a voltage summation circuit used in the multiplier circuit of the present invention.
Figure 13:
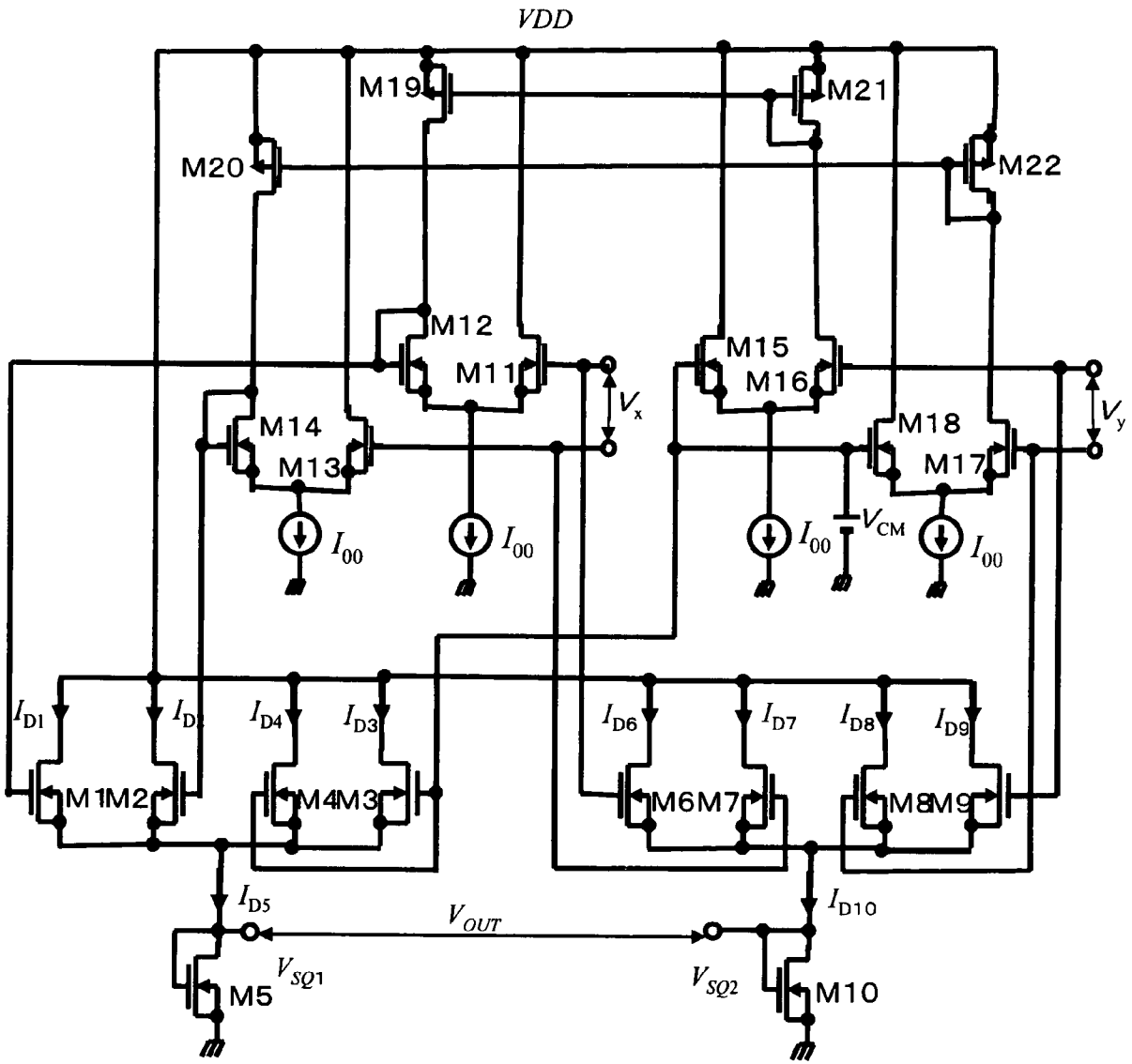
FIG. 13 is a circuit diagram showing the configuration of a multiplier circuit that makes use of the voltage summation circuit according to the present invention.

FIG. 12 depicts a circuit diagram showing a voltage summation circuit used in the multiplier circuit according to claim 4. FIG. 13 is a circuit diagram showing an example of a multiplier circuit according to the present exemplary embodiment (corresponding to claim 3).

In FIG. 12, a voltage summation circuit, making use of MOS differential pairs, is also shown in FIG. 4. Referring to FIG. 12, the voltage summation circuit includes a first MOS transistor pair (M1, M2), a second MOS transistor pair (M3, M4), a thirds MOS transistor pair (M5, M6), a fourth MOS transistor pair (M7, M8), a first current mirror circuit (M11, M9) and a second current mirror circuit (M12, M10). The first MOS transistor pair (M1, M2) is composed of a first current source ($I_{00}$) having one end connected to the ground GND, and MOS transistors M1 and M2 having sources connected in common and connected to the first current source ($I_{00}$). The MOS transistor M1 has its drain connected to a power supply VDD and receives, at its gate, a positive phase voltage signal ($V_{CM}+V_x/2$) of the first input signal ($V_x$). The MOS transistor M2 is connected as a diode. The second MOS differential pair (M3, M4) is composed of a second current source ($I_{00}$) having one end connected to the ground GND, and MOS transistors M3 and M4 having sources connected in common and connected to the second current source ($I_{00}$). The MOS transistor M3 has its drain connected to a power supply VDD and receives, at its gate, a reverse phase voltage signal ($V_{CM}-V_x/2$) of the first input signal ($V_x$). The MOS transistor M4 is connected as a diode. The third MOS differential pair (M5, M6) is composed of a third current source ($I_{00}$) having one end connected to the ground GND, and MOS transistors M5, M6 having sources connected in common and connected to the third current source ($I_{00}$). The MOS transistor M6 receives at its gate a positive phase voltage signal ($V_{CM}+V_y/2$) of the second input signal ($V_y$). The MOS transistor M5 has its drain connected to the power supply VDD and receives, at its gate, a common mode voltage $V_{CM}$ of the second input signal ($V_y$). The fourth MOS differential pair (M7, M8) is composed of a fourth current source ($I_{00}$) having one end connected to the ground GND, and MOS transistors M7 and M8 having sources connected in common and connected to the third current source ($I_{00}$). The MOS transistor M7 receives at its gate a reverse phase voltage signal ($V_{CM}-V_y/2$) of the second input signal ($V_y$). The MOS transistor M8 has its drain connected to the power supply VDD and receives, at its gate, a common mode voltage $V_{CM}$ of the second input signal. The first current mirror circuit has its input connected to the drain of the MOS transistor M6 of the third MOS differential pair, while having an output connected to the aforementioned diode-connected MOS transistor M2 of the first differential pair. The second current mirror circuit has its input connected to the drain of the MOS transistor M7 of the fourth MOS differential pair, while having an output connected to the aforementioned diode-connected MOS transistor M4 of the second MOS differential pair. The MOS differential pairs (M1, M2) and (M3, M4) of the differential pair of FIG. 12 are equivalent to the MOS differential pairs (M1, M2) and (M3, M4) of FIG. 8. The MOS differential pairs (M5, M6) and (M7, M8) of the differential pair of FIG. 12 are equivalent to the MOS differential pair (M9, M10) and (M11, M12) of FIG. 8. The current mirror circuits (M9, M11) and (M10, M12) of FIG. 12 are equivalent to the current mirror circuits (M13, M17) and (M14, M19) of FIG. 8. $2V_{CM}+V_x/2+V_y/2$ is presented at a drain-gate connection node of the MOS transistor M2, whilst $2V_{CM}+V_x/2-V_y/2$ is presented at a drain-gate connection node of the MOS transistor M4. A differential sum voltage $V_x+V_y$ is supplied as output across drain-gate connection nodes of the MOS transistors M2 and M4.

Referring to FIG. 13, two voltage summation circuits, each of which is shown in FIG. 4, are used to generate a differential output voltage, because the squaring summation circuit of claim 3 is in need of a differential input voltage. The differential pairs (M1, M2) and (M3, M4) with the current source M5 and the differential pairs (M6, M7) and (M8, M9) with the current source M10 of FIG. 13 are equivalent to the corresponding components of FIG. 11.

Referring to FIG. 13, $$V_{IN}=V_{CM}+V_y/2$$

and $$V_{IN}'=V_{CM}-V_y/2$$

are respectively applied to the gate of the one transistor M16 of the MOS transistor pair (M15, M16) and to the gate of the one transistor M17 of the MOS transistor pair (M17, M18). A common mode voltage $V_{CM}$ is applied to each of the gates of the other transistors M15 and M18.

Also, $$V_{REF}=V_{CM}+V_x/2$$

and $$V_{REF}'=V_{CM}-V_x/2$$

are respectively applied to the gate of the one transistor M11 of the MOS transistor pair (M11, M12) and to the gate of the one transistor M13 of the MOS transistor pair (M13, M14). An output voltage $$V_{OUT}=2V_{CM}+V_x/2+V_y/2$$

is provided at a drain-gate connection terminal of the other MOS transistor M12, whilst an output voltage $$V_{OUT}'=2V_{CM}-V_x/2-V_y/2$$

is provided at a drain-gate connection terminal of the other MOS transistor M14. A differential output voltage $V_x+V_y$ across the drain-gate connection terminals of the MOS transistors M12, M14 is differentially supplied to the gates of the differential pair (M1, M2). The common mode voltage $V_{CM}$ is supplied common to the gates of the differential pair (M3, M4). As in FIG. 11, $V_x$ is differentially supplied to the gates of the differential pair (M6, M7), whilst $V_y$ is differentially supplied to the gates of the differential pair (M8, M9).

The operating range of the voltage summation circuit is equal to that of the MOS differential pair, such that $$|V_x+V_y| \le \sqrt{\frac{I_{00}}{\beta}} \tag{44}$$

The operating range becomes maximum by setting the respective right sides of the equations (41), (42) and (44) so as to be equal to one another. It is noted that not the inside of the rounded lozenge shape as mentioned above, but a circle inscribing the lozenge shape represents the maximum operating point. This maximum operating point may be found by setting $V_1=V_2$ in the equations (41) and (42). It is then sufficient to set $$2(\sqrt{2}-1)(V_{CM}-2V_{TH})=\sqrt{\frac{I_{00}}{\beta}} \tag{45}$$

The present invention may be used as an analog signal processing circuit, a rectifier circuit, a detection circuit, a frequency transform circuit or an automatic gain controller, only by way of examples.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A multiplier circuit comprising:

a voltage summation circuit that receive first and second input voltages and produces a differential sum voltage of the first and second input voltages; and a voltage subtraction circuit that receive the first and second input voltages and produces a differential subtraction voltage of the first and second input voltages;

a first squaring circuit including:

a diode-connected first MOS transistor; and a first differential MOS transistor pair that is connected in cascode to the diode-connected first MOS transistor and receives the differential sum voltage, an output of the first squaring circuit being a first terminal voltage of the diode-connected first MOS transistor; and a second squaring circuit including:

a diode-connected second MOS transistor; and a second differential MOS transistor pair that is connected in cascode to the diode-connected second MOS transistor and receives the differential subtraction voltage, an output of the second squaring circuit being a second terminal voltage of the diode-connected second MOS transistor, a differential voltage between the first and second terminal voltages of the first and second squaring circuits corresponding to a product of the first and second input voltages.

2. The multiplier circuit according to claim 1, further comprising fifth and sixth MOS differential pairs, provided common to the voltage summation circuit and the voltage subtraction circuit, the fifth and sixth MOS differential pairs receiving respectively the second input voltage, wherein the voltage summation circuit includes first and second MOS differential pairs respectively receiving the first input voltage; and the voltage subtraction circuit includes third and fourth MOS differential pairs respectively receiving the first input voltage;

wherein in the voltage summation circuit, a positive phase signal of the first input voltage is supplied to a gate of one MOS transistor of the first MOS transistor pair and the other MOS transistor of the first MOS transistor pair is diode-connected to form a positive phase output terminal; and a reverse phase signal of the first input voltage is supplied to a gate of one MOS transistor of the second MOS transistor pair and the other MOS transistor of the second MOS transistor pair is diode-connected to form a reverse phase output terminal;

wherein in the voltage subtraction circuit, a positive phase signal of the first input voltage is supplied to a gate of one MOS transistor of the third MOS transistor pair and the other MOS transistor of the third MOS transistor pair is diode-connected to form a positive phase output terminal; and a reverse phase signal of the first input voltage is supplied to a gate of one MOS transistor of the fourth MOS transistor pair and the other MOS transistor of the fourth MOS transistor pair is diode-connected to form a reverse phase output terminal;

wherein a positive phase signal of the second input voltage is supplied to a gate of one MOS transistor of the fifth MOS transistor pair and a common mode voltage of the second input voltage is supplied to a gate of the other MOS transistor of the fifth MOS transistor pair; and a reverse phase signal of the second input voltage is supplied to a gate of one MOS transistor of the sixth MOS transistor pair and the common mode voltage of the second input voltage is supplied to a gate of the other MOS transistor of the sixth MOS transistor pair; and wherein currents flowing respectively through the one MOS transistors of the fifth and sixth MOS differential pairs, which receive the positive and reverse phase signals of the second input voltage, are supplied via first and second current mirror circuits, respectively, to positive and reverse phase terminals of the voltage summation circuit, respectively; and currents flowing respectively through the other transistors of the fifth and sixth MOS differential pairs, which receive the common mode voltage, are supplied via third and fourth current mirror circuits, respectively, to positive and reverse phase terminals of the voltage subtraction circuit, respectively.

3. The multiplier circuit according to claim 1, wherein in the first squaring circuit, the first differential MOS transistor pair has sources connected in common, has drains connected in common to a first power supply and has gates supplied with the input voltage differentially; and the first MOS transistor has a source connected to a second power supply, has a drain connected to the coupled sources of the first differential MOS transistor pair, and has the drain and a gate coupled together; wherein in the second squaring circuit, the second differential MOS transistor pair has sources connected in common, has drains connected in common and connected to the first power supply, and has gates supplied with the input voltage differentially; and the second MOS transistor has a source connected to the second power supply, has a drain connected to the coupled sources of the second differential MOS transistor pair, and has the drain and a gate coupled together;

a voltage equivalent to the square of the input voltage being obtained from the drains of the first and second MOS transistors.

4. A multiplier circuit comprising:

a voltage summation circuit which receives a first input voltage and a second input voltage and produces a differential sum voltage of the first and second input voltages;

a first MOS differential pair which differentially receives the differential sum voltage of the first and second input voltages;

a second MOS differential pair which receives a common mode voltage;

a third MOS differential pair which differentially receives the first input voltage;

a fourth MOS differential pair which differentially receives the second input voltage;

a first diode-connected MOS transistor to which the first and second MOS differential pairs are cascode-connected in common; and a second diode-connected MOS transistor to which the third and fourth MOS differential pairs are cascode-connected in common;

a differential voltage between a terminal voltage of the first diode-connected MOS transistor and a terminal voltage of the second diode-connected MOS transistor corresponding to a product of the first and second input voltages.

5. The multiplier circuit according to claim 4, wherein the voltage summation circuit comprises:

first and second MOS differential pairs respectively receiving the first input voltage; and third and fourth MOS differential pairs respectively receiving the second input voltage; wherein in the voltage summation circuit, a positive phase signal of the first input voltage is supplied to a gate of one MOS transistor of the first MOS transistor pair and the other MOS transistor of the first MOS transistor pair is diode-connected to form a positive phase output terminal;

a reverse phase signal of the first input voltage is supplied to a gate of one MOS transistor of the second MOS transistor pair and the other MOS transistor of the second MOS transistor pair is diode-connected to form a reverse phase output terminal;

a positive phase signal of the second input voltage is supplied to a gate of one MOS transistor of the third MOS transistor pair and a common mode voltage of the second input voltage is supplied to a gate of the other MOS transistor of the third MOS transistor pair;

a reverse phase signal of the second input voltage is supplied to a gate of one MOS transistor of the fourth MOS transistor pair and a common mode voltage of the second input voltage is supplied to a gate of the other MOS transistor of the fourth MOS transistor pair; and currents flowing through the one MOS transistors of the third and fourth MOS differential pairs, which receive the positive and reverse phase signals of the second input voltage, are supplied via first and second current mirror circuits, respectively, to positive and reverse phase terminals of the voltage summation circuit, respectively.

* * * * *